US007062978B1

(12) United States Patent
Hsien

(10) Patent No.: US 7,062,978 B1
(45) **Date of Patent: *Jun. 20, 2006**

(54) HAND TOOL WITH STRAIN GAUGES

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/146,259

(22) Filed: Jun. 7, 2005

(51) Int. Cl.
*B25B 23/14* (2006.01)

(52) U.S. Cl. ..... 73/862.21

(58) Field of Classification Search ..... 73/862.21, 73/862.22, 862.23
See application file for complete search history.

(56) References Cited

U.S. PATENT DOCUMENTS 1,793,714 A * 2/1931 Emil ..... 81/125.1
5,172,614 A * 12/1992 Monnet et al. ..... 81/119
6,655,239 B1 * 12/2003 Macor ..... 81/125.1
6,920,811 B1 * 7/2005 Hsien ..... 81/467
6,928,885 B1 * 8/2005 Shiao et al. ..... 73/862.21
2004/0261542 A1 * 12/2004 Hsien ..... 73/862.21
2004/0261588 A1 * 12/2004 Hsien ..... 81/467

* cited by examiner

*Primary Examiner*—Max Noori

(57) ABSTRACT

A hand tool with strain gauges comprises a tool body; and the tool body having a handle; each of a front end and a rear end of the handle being extended with respective driving portions; each driving portion having a driving head for driving a screw means; each end of the handle being formed with a groove near a respective one of the driving portion; each groove being formed with at least one notch for concentrating stress forces; at least one side wall of each groove being installed with a strain gauge; the handle being installed with two integrating elements; each integrating element being electrically connected to a respective one of the strain gauges.

6 Claims, 4 Drawing Sheets

HAND TOOL WITH STRAIN GAUGES

FIELD OF THE INVENTION

The present invention relates to strain gauges on a handle tool, and in particular to a hand tool with strain gauges, wherein the strain gauges are installed at a wall of a groove and the groove is formed with notches so that the strain gauge can have a precise value of the twisting force applied to the handle tool.

BACKGROUND OF THE INVENTION

Current hand tools are arranged with a strain gauge to measure the twisting force applied to the handle tool. In the prior art the sensitivity of the strain gauge is not so sensitive so that derived stresses are not precise and thus users cannot apply proper force according to the values. As a result, it is possible that the handle tool is destroyed or the screw means cannot be well fixed.

To improve above mentioned defect, a round groove is formed on the handle tool and the strain gauge is installed in the groove so that stresses are concentrated upon the groove and the strain gauge can have precise values. However the stresses concentrate upon the wall of the groove, but the groove is round so that the strain gauge cannot fully sense the twisting force. In fact, the strain gauge is installed at the radial direction of the round groove. Thereby it cannot effectively improve the defect in the prior art.

In another improvement, U.S. Pat. No. 5,503,028, the strain gauge is installed at an outer side of the handle tool although a hole is formed. Thus it still cannot get a precise value.

SUMMARY OF THE INVENTION

Accordingly, the primary object of the present invention is to provide a hand tool with strain gauges, wherein the strain gauges are installed at a wall of a groove and the groove is formed with notches so that the strain gauge can have a precise value of the twisting force applied to the handle tool.

To achieve above objects, the present invention provides a hand tool with strain gauges which comprises a tool body; and the tool body having a handle; each of a front end and a rear end of the handle being extended with respective driving portions; each driving portion having a driving head for driving a screw means; each end of the handle being formed with a groove near a respective one of the driving portion; each groove being formed with at least one notch for concentrating stress forces; at least one side wall of each groove being installed with a strain gauge; the handle being installed with two integrating elements; each integrating element being electrically connected to a respective one of the strain gauges.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
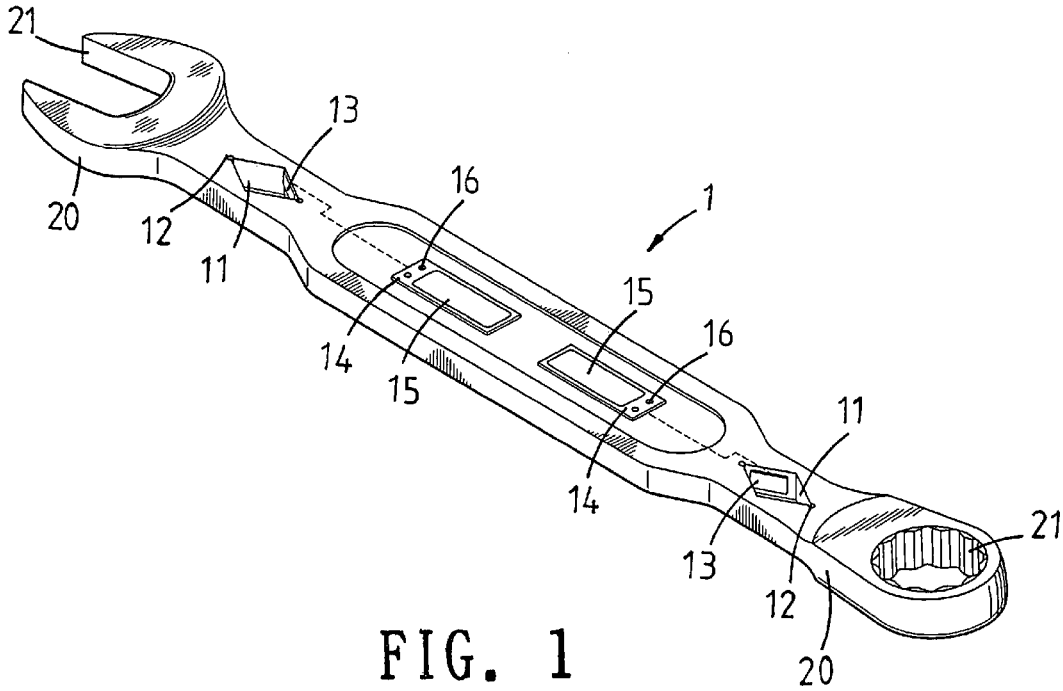
FIG. 1 is a schematic view of the present invention.
Figure 2:
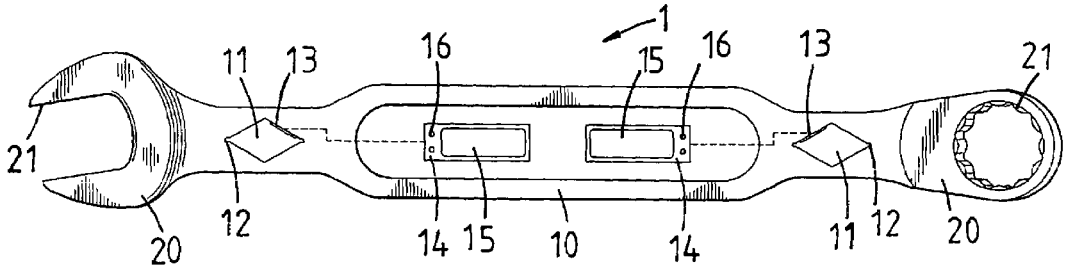
FIG. 2 is an elevational view of the present invention.
Figure 3:
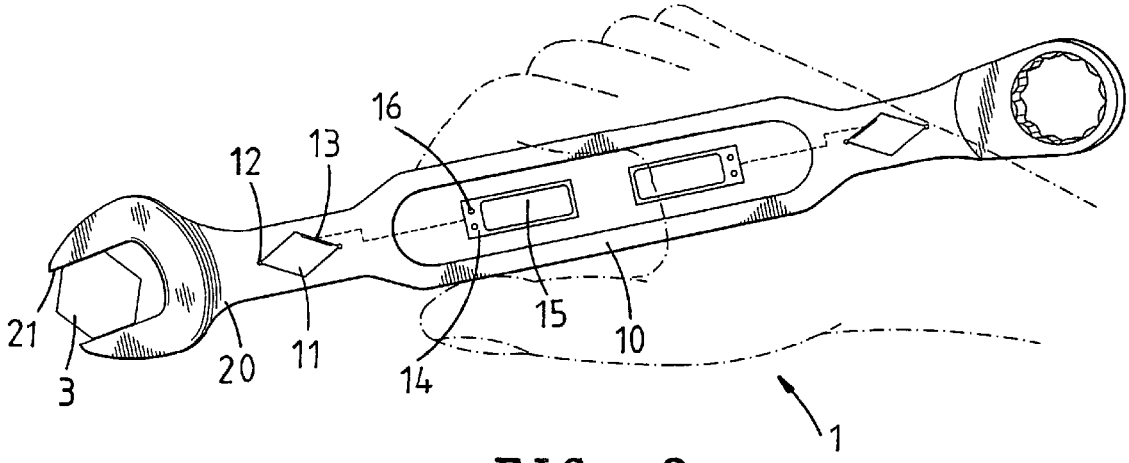
FIG. 3 is a schematic view showing the operation of the present invention.

The present invention relates to a hand tool with strain gauges. Referring to FIGS. 1 to 3, the hand tool has a tool body 1. The tool body 1 has a handle 10.

A front end and a rear end of the handle 10 are extended with respective driving portions 20. Each driving portion 20 has a driving head 21 for driving a screw means 3.

Each end of the handle 10 is formed with a groove 11 near a respective one of the driving portion 20. Each of the front end and a rear end of the groove 11 is formed with a notch 12 for guiding stress to concentrate. One side wall of each groove 11 is installed with a strain gauge 13. The handle 10 is installed with two integrating elements 14. Each integrating element 14 is electrically connected to a respective one of the strain gauges 13. Each integrating element 14 has a display 15 and an adjusting button 16. When the user drives a screw means 3 by a driving head 21 of the driving portion 20, the strain gauge 13 can suffer from a great stress by the groove 11 and the notches 12. Furthermore, it has a preferred deformation and sensitivity. When a force is applied to the strain gauge 13 to deform, the resistance of the strain gauge 13 will change. The integrating element 14 can determine the twisting force of the driving portion 20 by the deformation of the strain gauge 13 and the twisting value is displayed on the display 15 of the integrating element 14. The adjusting button 16 serves for adjusting the display unit, setting and calibration.

Referring to FIG. 3, in the present invention, the driving head 21 of the driving portion 20 at the front end of the tool body 1 is engaged to a screw means. The screw means 3 is driven by applying a force to the handle 10. The tool body 1 will suffer a force from the hand of the user. The groove 11 can be twisted so that the strain gauge 13 deform with a greater amount. The integrating element 14 can determine the twisting force by the deformation of the strain gauge 13. Thus the sensitivity of the strain gauge 13 is greatly increased. The fault due to wrong twisting force is avoid so as to reduce the destroy of the tool body 1.

Figure 4:
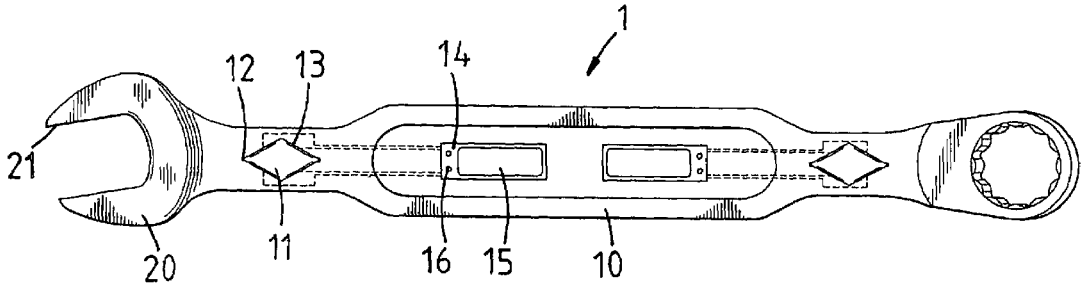
FIG. 4 is an elevational view of the second embodiment of the present invention.

Referring to FIG. 4, the second embodiment of the present invention is illustrated. The elements same as the first embodiment will not be described herein. Only the difference of the two embodiments is described. Each of four sides of the groove 11 is installed with a respective strain gauge 13. The four strain gauges 13 are integrated as a bride circuit so as to get a precise value of the twisting force applied to the tool body 1.

Figure 5:
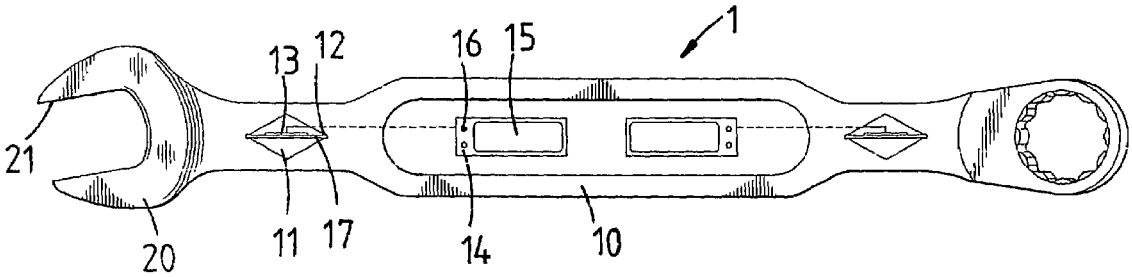
FIG. 5 is an elevational view of the third embodiment of the present invention.

Referring to FIG. 5, the third embodiment of the present invention is illustrated. Those identical to the first embodiment will not be further described herein. A plate 17 is installed in the groove 11. The plate 17 is made of extendable metal or plastics. The strain gauge 13 is placed in the plate 17. When a force is applied to the tool body 1, the strain gauge 13 deforms with the plate 17 so as to increase the sensitivity of the twisting force.

Figure 6:
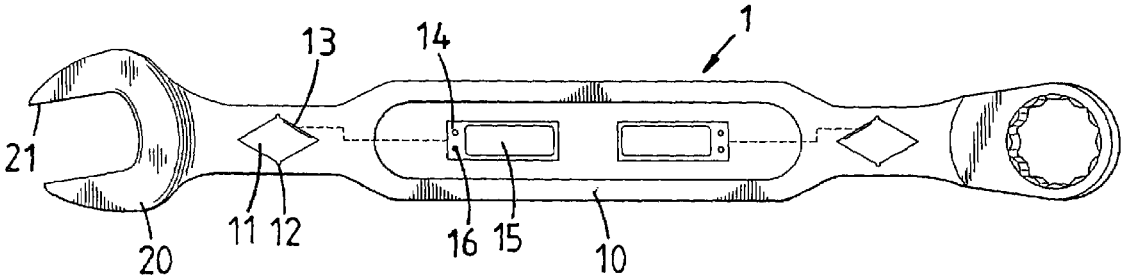
FIG. 6 is an elevational view of the fourth embodiment of the present invention.

Referring to FIG. 6, the fourth embodiment of the present invention is illustrated. Those identical to the first embodiment will not be further described herein. Only those different are described. The notches 12 of the grooves 11 can be described at the two lateral ends thereof so as to achieve the object of increase the sensitivity.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hand tool with strain gauges comprising:

a tool body; and the tool body having a handle;

each of a front end and a rear end of the handle being extended with respective driving portions; each driving portion having a driving head for driving a screw means;

each end of the handle being formed with a groove near a respective one of the driving portions; each groove being formed with at least one notch for concentrating stress forces; at least one side wall of each groove being installed with a strain gauge; the handle being installed with two integrating elements; and each integrating element being electrically connected to a respective one of the strain gauges.

2. The hand tool with strain gauges as claimed in claim 1, wherein each integrating element having a display and an adjusting button.

3. The hand tool with strain gauges as claimed in claim 1, wherein there are four strain gauges at four sides of each groove; the four strain gauges are formed as a bridge circuit so as to get a precise value of a twisting force.

4. The hand tool with strain gauges as claimed in claim 1, wherein a plate is installed in the groove; and a strain gauge is installed on the plate.

5. The hand tool with strain gauges as claimed in claim 1, wherein each of the front end and a rear end of the groove being formed with a notch for concentrating stress force.

6. The hand tool with strain gauges as claimed in claim 1, wherein each groove is formed with a regular shape.

* * * * *